United States Patent [19]

Beeler

[11] Patent Number: 4,687,130

[45] Date of Patent: Aug. 18, 1987

[54] DISPOSABLE ICE AND BEVERAGE CONTAINER

[75] Inventor: Robert J. Beeler, Hanover, Pa.

[73] Assignee: Beeler Mfg. Co., Hanover, Pa.

[21] Appl. No.: 931,348

[22] Filed: Nov. 17, 1986

[51] Int. Cl.[4] ..... B65D 5/24

[52] U.S. Cl. ..... 229/114; 229/45 R; 229/149; 229/152; 229/177; 229/188; 229/906; 229/911

[58] Field of Search ..... 229/113, 114, 147, 149, 229/152, 160, 177, 188, 902, 906, 910, 911, 915, 45 R, DIG. 11

[56] References Cited

U.S. PATENT DOCUMENTS

| | | | |
|---|---|---|---|
| 1,352,833 | 9/1920 | Robinson | 229/45 R |
| 3,486,680 | 12/1969 | Negus, Jr. | 229/915 |
| 3,559,869 | 2/1971 | Reynolds | 229/902 |
| 3,623,650 | 11/1971 | Watts | 229/45 R |
| 3,809,310 | 5/1974 | Vanderlugt, Jr. | 229/902 |
| 3,899,121 | 8/1975 | Herbetko | 229/915 |
| 4,236,740 | 12/1980 | Sorenson et al. | 229/160 |
| 4,304,353 | 12/1981 | Stollberg | 229/45 R |
| 4,391,405 | 7/1983 | Drinon | 229/188 |

FOREIGN PATENT DOCUMENTS

| | | | |
|---|---|---|---|
| 2411134 | 7/1979 | France | 229/149 |
| 869982 | 6/1961 | United Kingdom | 229/149 |

*Primary Examiner*—Stephen Marcus
*Assistant Examiner*—Gary E. Elkins
*Attorney, Agent, or Firm*—Daniel J. O'Connor

[57] ABSTRACT

A disposable ice, food or beverage carrier which is fabricated of corrugated fiberboard materials. A single piece of bendable corrugated fiberboard is factory die cut and scored in such manner that it may be easily folded into a container assembly for use by picnickers or other persons requiring a temporary insulative container. The score and cut-line designs disclosed yield a highly durable temporary food container.

1 Claim, 4 Drawing Figures

DISPOSABLE ICE AND BEVERAGE CONTAINER

BACKGROUND AND OBJECTS OF THE INVENTION

The use of insulative ice, food and beverage containers is generally well-known in the art.

In recent years smaller polyfoamed containers have been widely marketed. However, such prior art containers suffer the drawback of having a high shipping volume thus increasing shipping and marketing costs. It is also known that the tops of such prior art containers often do not provide an effective insulative seal for their intended use.

The use of foldable container-related corrugated fiberboard articles is also known in the prior art. However, such prior art systems typically require overly complex assembly procedures and yet do not result in a stable folded end product.

The prior art patents presently known to the inventor herein to be related to this application are listed as follows: U.S. Pat. No. 2,581,100 issued to Hennessy on Jan. 1, 1952; U.S. Pat. No. 3,261,619 issued to Norgaard on July 19, 1966.

Accordingly, it is an object of the present invention to provide an ice, food or beverage container which may be shipped in a flat knockdown position and yet be readily assembled at the retail level by persons unfamiliar with such items.

It is a further object of the invention to demonstrate a disposable container which is made of a highly economical material such as corrugated fiberboard.

It is also an object of the invention to provide a container with a greatly reduced shipping volume to reduce shipping costs and thereby provide savings to the ultimate consumer.

It is a still further object of the invention to set forth a disposable container for foods, ice or beverages which provides an insulating effect by reason of the inherent corrugated fiberboard air cell structure.

It is a further object to provide an easily foldable one-piece container which has its components configured such that a high degree of structural integrity is achieved as compared to prior art systems.

These and other objects and advantages of the present invention will become apparent as the following description proceeds, and the features of novelty characterizing the invention will be pointed out with particularity in the claims annexed to and forming a part of this specification.

BRIEF SUMMARY OF THE INVENTION

The invention includes a single sheet of corrugated fiberboard material with a central or bottom panel formed in the middle thereof via factory applied score or folding lines. Surrounding the bottom panel are four side panels which are joined to each other by way of pairs of tab panels.

Each of the aforesaid tab panels have tabs which are formed at outer edges thereof and which lie remote from their respective adjoining side panels.

The pairs of tab panels have score lines formed therebetween so that they may be folded into facing relationship and subsequently folded onto one of the side panels into a position where the tabs are received by way of a cut-line formed in each of the second and fourth side panels.

The first and third side panels have, formed at the outer edges thereof, first and second top panels which serve as a covering means for the container and serve to enhance structural integrity of the overall unit by way of slots formed therein which interact with the aforementioned tab elements.

BRIEF DESCRIPTION OF THE DRAWING FIGURES

FULL DESCRIPTION OF THE PREFERRED EMBODIMENT

Figure 1:
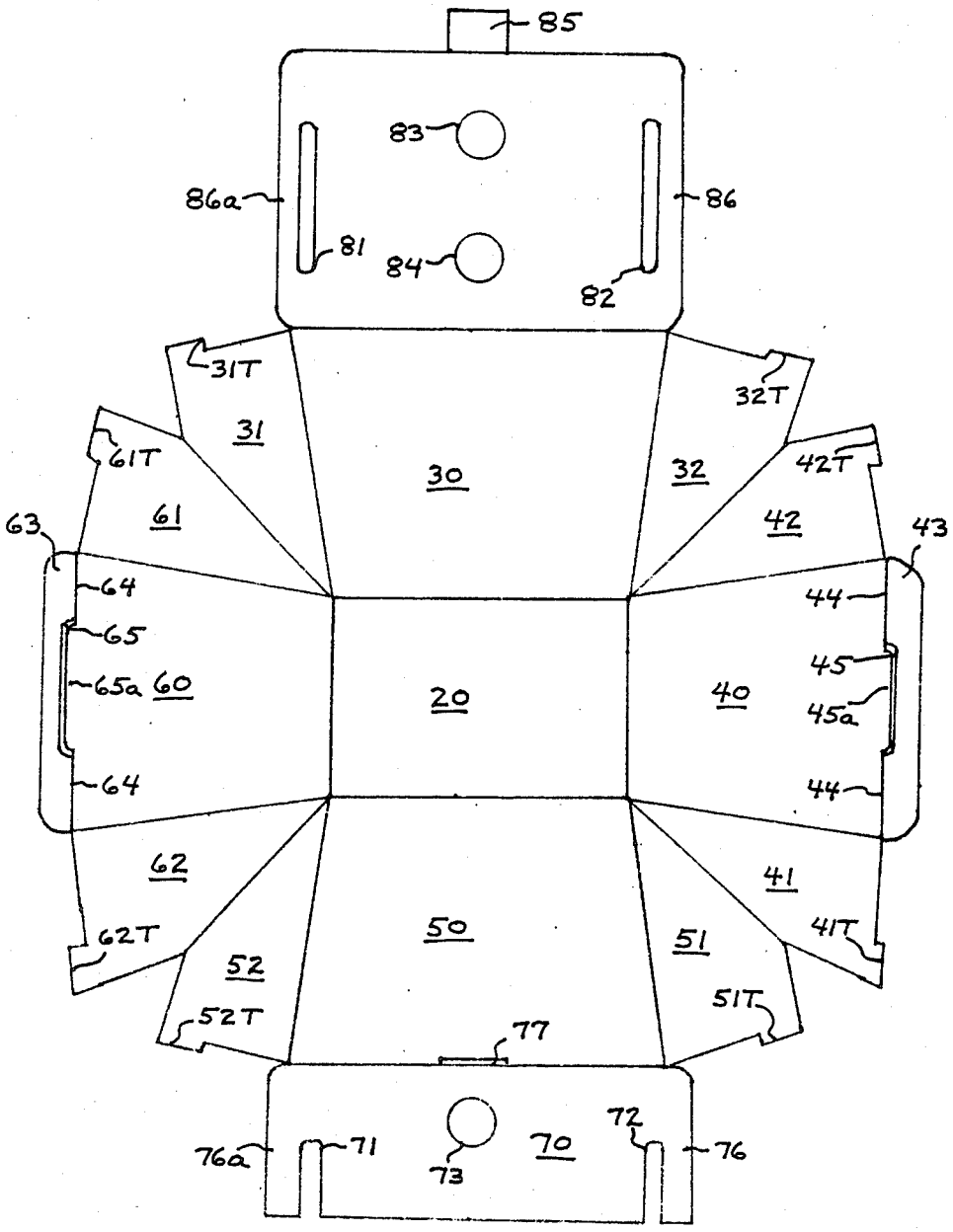
FIG. 1 shows the container of the present invention in its flat or knockdown form.

Referring now to FIG. 1 in detail, there is shown a central panel 20 which serves as the bottom panel of the overall container upon assembly.

Surrounding the bottom panael 20 and defined by the score lines at the edges of panel 20 are four side panels, namely: a first side panel 30, a second side panel 40, a third side panel 50 and a fourth side panel 60.

As further shown in FIG. 1, between each of the side panels there are formed pairs of tab panels. For example, between first and second side panels 30 and 40, tab panels 32 and 42 are formed. Similarly, tab panels 41 and 51, 52 and 62, 31 and 61 are formed around the device.

The tab panels are denominated as such because each has a tab element formed on an outer edge thereof and remote from its adjoining side panel. Thus, tab 32T is formed on an outer edge of tab panel 32 at a position remote from its adjoining side panel 30. Similarly, tabs 42T, 41T, 51T, 52T, 62T, 61T and 31T are formed around the structure for a total of eight tabs formed on the eight separate tab panels.

As further shown in FIG. 1, the second side panel 40 has a top supporting flap means 43 formed at the outer edge thereof for supporting the top elements 76 and 86 upon assembly as will be further described. Flap 43 is formed by way of score lines 44 and a central curved cut-line 45. Thus, as will be appreciated, flap 43 is bent downwardly ninety degrees upon assembly of the device to form an upstanding side panel tab **45*a***.

In similar fashion, the fourth side panel 60 has a top supporting flap means 63 formed at the outer edge thereof for supporting the top elements **76*a* and 86*a* upon assembly as will be further described. Flap 63 is similarly formed by way of score line 64 and a central curved cut-line 65. Flap 63 is also bent downwardly ninety degrees upon assembly of the device to form an upstanding side panel tab 65*a***.

Completing the structure of FIG. 1, there is also shown a first top panel 70 which adjoins the outer edge of the third side panel 50 via a score line therebetween. Open-ended slots 71 and 72 are formed at the outer edge of top panel 70 a shown. A central aperture means 73 is also formed on top panel 70 to aid in grasping and manual transportation of the assembled device. A cut line means 77 is formed at an inner edge of top panel 70 for receipt of a locking flap member as will be further described.

Figure 3:
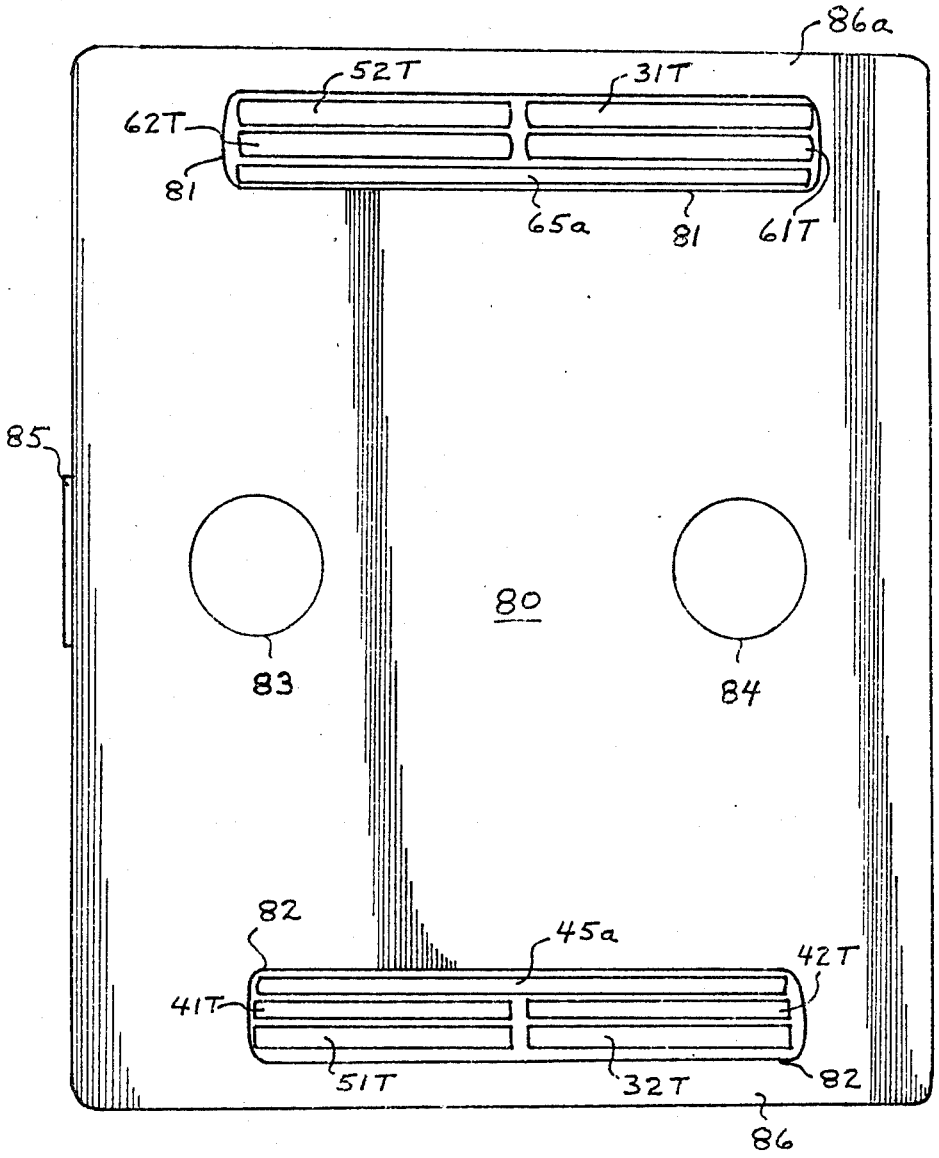
FIG. 3 shows a top assembled view of the unit which illustrates the grouping of the various tab elements for ease of assembly and structural integrity.

A second top panel 80, which serves as an openable covering for the device upon assembly, adjoins the outer edge of the first side panel 30 via score lines formed therebetween. Top or cover panel 80 has elongated closed slot means 81 and 82 formed at lateral portions thereof as shown. Slot 82 is formed and located so as to fit over upstanding tabs 32T, 42T, 41T, 51T and upstanding side panel tab 45*a* upon assembly of the device as is illustrated in the top assembled view of FIG. 3. Similarly, slot 81 is formed and located so as to fit over upstanding tabs 31T, 61T, 52T, 62T and upstanding side panel tab 65*a* upon assembly of the device as shown in FIG. 3. Two manual grasping apertures 83 and 84 are formed in the central area of top panel 80. It is noted that aperture 83 is located such that it will directly overlie aperture 73 in top panel 70 upon assembly of the device.

The second top panel 80 further has a locking flap element 85 formed at an outer edge thereof and sized so as to be engagingly received by cut line 77 formed in the first top panel 70 upon assembly of the device.

Assembly of the device is accomplished by manually grasping the first side panel 30 and the third side panel 50 and folding them upwardly approximately ninety degrees. Such folding, by reason of the various score lines shown, causes tab panels 32 and 42 to come into facin relationship with each other. A similar facing relationship occurs between tab panels 41 and 51, 52 and 62, and 31 and 61 respectively.

Flap 43 is folded downwardly ninety degrees and the tab panels 32, 52 and 41, 51 are folded around the outside of the container in such manner that their tabs are locked in their assembled position between flap 43 and side panel 40 in an aperture formed by way of the cutline 45.

Figure 2:
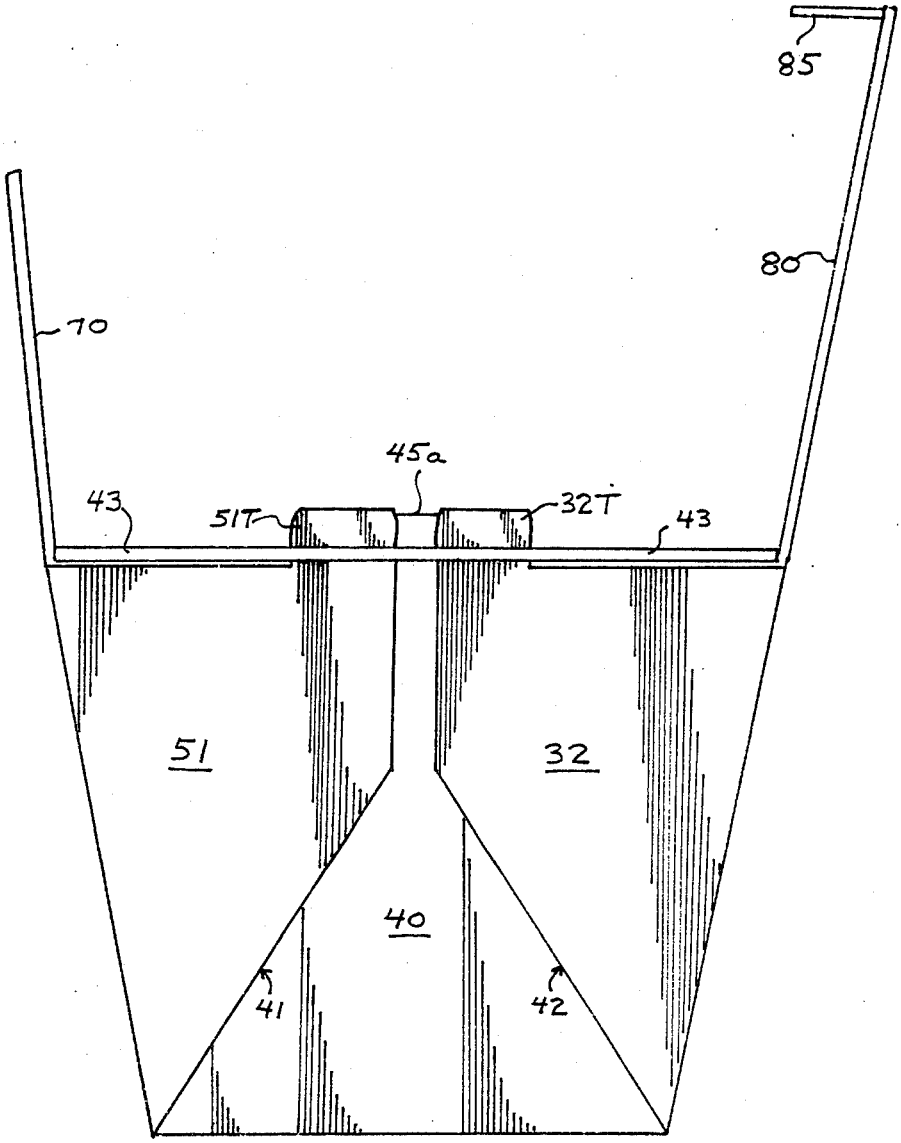
FIG. 2 shows a side view of the container in a partially assembled view to demonstrate the advantageous interlocking aspects of the invention.

Thus, as shown in the partly assembled view of FIG. 2, tab panels 32 and 51 are on the outside of side panel 40 and partially covering it. Upon assembly tab panel 42 is sandwiched between tab panel 32 and side panel 40. Tab panel 41 is sandwiched between tab panel 51 and side panel 40. Thus, tab panels 41 and 42 are hidden from view in FIG. 2.

The various tab elements 32T, 42T, 41T, 51T and 45*a* are thus grouped together and lie in an upstanding position as shown in FIG. 2. In the side view of FIG. 2, tab 41T is hidden behind tab 51T and tab 42T is hidden behind tab 32T. It will be appreciated by those of skill in the art that a similar folding of side and tab panels occur with regard to the fourth side panel 60.

The various upstanding tab elements are thus grouped as shown in the top fully assembled and closed view of FIG. 3. It is noted that FIG. 2 shows the first and second top closure panels 70 and 80 in an open position.

A sealing closure of the device is accomplished by folding the first top panel 70 downwardly from the position of FIG. 2 such that its open-ended slot elements 71 and 72 fit around a least portions of the various upstanding tab elements.

Next, the second top panel 80 is folded downwardly from its position in FIG. 2 such that its slots 81 and 82 fit around all of the various upstanding tab elements. Thus, as shown in the top assembled view of FIG. 3, the slot 82 of top panel 80 fits around the five upstanding tabs 32T, 51T, 41T, 42T and 45*a*. Similarly, the slot 81 of top panel 80 fits around the five upstanding tabs 31T, 52T, 61T, 62T and 65*a*.

Thus, the slot elements formed in top panels 70 and 80 allow the top panels to be closed fully and to sealingly rest upo the side panel flaps 43 and 63 when closure of the device is required.

As shown in FIG. 3, the closure flap 85 would be positioned in locking mode in cooperation with cut line 77 previously described and shown in FIG. 1.

It will thus be appreciated by those of skill in the art that the unique score line and tab formations of the present invention result in a disposable container of high structural integrity by reason of the grouping of the various upstanding tab elements into two locking areas upon assembly. Such grouping of the various tab elements also results in a container which is relatively easy to assembly from its flat or knockdown position.

Figure 4:
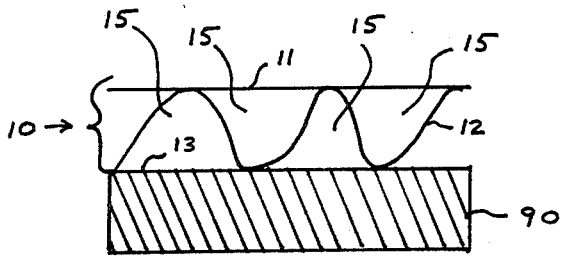
FIG. 4 illustrates the corrugated fiberboard used in the invention and an insulative layer which may be adhesively applied thereto.

As previously described, the one-piece container of the present invention is composed of corrugated fiberboard material. As shown in FIG. 4, corrugated fiberboard 10 typically comprises an upper layer 11, a middle sinuous layer 12 and a lower layer 13, all made of paper materials. By reason of the middle sinuous layer 12, air cells 15 are typically formed in corrugated fiberboard materials. Such air cells 15 prove to be highly advantageous in the present inventive use because of their insulating effect. Thus, the air cells 15 enhance the food, ice or beverage container in its intended temperature preservation function.

The inventor herein has found that it may be also advantageous to add a layer of insulation 90 to the various side, top and bottom panels to even further enhance the desired insulative function. It is contemplated that such insulation 90 would be affixed to the corrugated fiberboard by means presently known in the art such as adhesive bonding or foam spraying.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A corrugated fiberboard panel (10) having score an cut-lines formed thereon providing means for use of said corrugated fiberboard panel (10) as a disposable container device for ice, food or beverages, wherein said corrugated fiberboard panel comprises:

a rectangular bottom panel (20) having first, second, third and fourth sides, a first side panel (30) formed via score line means to lie adjacent a first side of said rectangular bottom panel (20), said first side panel (30) a first tab panel means (31) formed on one lateral side thereof and a second tab panel means (32) formed on an opposite lateral side thereof, a second side panel (40) formed via score line means to lie adjacent a second side of said rectangular bottom panel (20), said second side panel (40) having a third tab panel means (42) formed on one lateral side thereof and a fourth tab panel means (41) formed on an opposite lateral side thereof, a third side panel (50) formed via score line means to lie adjacent a third side of said rectangular bottom panel (20), said third side panel (50) having a fifth tab panel means (51) formed on one lateral side thereof and a sixth tab panel means (52) formed on an opposite lateral side thereof, a fourth side panel (60) formed via score line means to lie adjacent a fourth side of said rectangular bottom panel (20), said fourth side panel (60) having a seventh tab panel means (62) formed on one lateral side thereof and an eighth tab panel means (61) formed on an opposite lateral side thereof, wherein said second tab panel means (32) and said third tab panel means (42) are attached to each other via score line means formed therebetween, wherein said fourth tab panel means (41) and said fifth tab panel means (51) are attached to each other via score line means formed therebetween, wherein said sixth tab panel means (52) and said seventh tab panel means (62) are attached to each other via score line means formed therebetween, wherein said eighth tab panel means (61) and said first tab panel means (31) are attached to each other via score line means formed therebetween, wherein said first tab panel means (31) has a tab (31T) formed at an outer edge thereof and being remotely located with respect to said first side panel (30), and wherein each of the remaining tab panel means (32, 42, 41, 51, 52, 62, 61) have a tab element (32T, 42T, 41T, 51T, 52T, 62T, 61T) formed at an outer edge thereof and being remotely located with reference to their respective side panels (30, 40, 50, 60), wherein said second side panel (40 hs curved cut-line means (45) formed at an outer edge thereof for receipt of tabs formed on the second, third, fourth and fifth tab panels (32, 42, 41, 51) upon assembly of the device, wherein said fourth side panel (60) has curved cut-line means (65) formed at an outer edge thereof for receipt of tabs formed on the sixth, seventh, eighth and first tab panels (52, 62, 61, 31) upon assembly of the device, wherein said corrugated fiberboard panel (10) has top panel covering means (70, 80) formed as a part thereof for sealingly closing the disposable container formed upon assembly of the device, wherein said third side panel (50) has a first top panel means (70) formed at a lower edge thereof via score line means, wherein said first top panel means (70) has a cut-line means (77) formed at an internal edge thereof for receipt of a locking flap (85) upon assembly of the device, wherein said first top panel means (70) has open-ended slot means (71, 72) formed at an outer edge thereof and being sized so as to easily fit over the tabs formed on the fourth, fifth, sixth and seventh tab panels (41, 51, 52, 62) upon assembly of the device, wherein said first side panel means (30) has a second top panel means (80) formed at an upper thereof via score line means, wherein said second top panel means (80) has a first slot means (81) formed at a lateral edge thereof and being sized so as to fit over the tabs formed on the sixth, seventh, eighth and first tab panels (52, 62, 61, 31) upon assembly of the device, wherein said second top panel means (80) has a second slot means (82) formed at a lateral edge thereof and being sized so as to fit over the tabs formed on the second, third, fourth and fifth tab panels (32, 42, 41, 51) upon assembly of the device, wherein said second top panel means (80) has first and second grasping aperture means (83, 84) formed therein for manual transport of the disposable container formed upon assembly, wherein said second top panel means (80) has locking flap means (85) formed at an outer edge thereof for interaction with the cut-line means (77) formed in said first top panel means (70) upon assembly and closure of the disposable container, and wherein top supporting flap means (43, 63) are formed at the outer edges of said second side panel (40) and said fourth side panel (60) respectively and are adapted to be folded outwardly upon assembly to retain adjacently positioned tab elements and to serve as a support for lateral portions (76, 76*a*, 86, 86*a*) of the first top panel means (70) and the second top panel means.

* * * * *